US006672258B2

(12) United States Patent
Hayashida et al.

(10) Patent No.: US 6,672,258 B2
(45) Date of Patent: Jan. 6, 2004

(54) INTERMEDIATE HEAT EXCHANGER-INCORPORATED TYPE STEAM GENERATOR

(75) Inventors: Hitoshi Hayashida, Higashi-Ibaraki-gun (JP); Kuniaki Ara, Higashi-Ibaraki-gun (JP)

(73) Assignee: Japan Nuclear Cycle Development Institute, Ibaraki-ken (JP)

( * ) Notice: Subject to any disclaimer, the term of this patent is extended or adjusted under 35 U.S.C. 154(b) by 0 days.

(21) Appl. No.: 10/138,306

(22) Filed: May 6, 2002

(65) Prior Publication Data

US 2003/0094146 A1 May 22, 2003

(30) Foreign Application Priority Data

Nov. 19, 2001 (JP) ..... 2001-352684

(51) Int. Cl.[7] ..... F22D 7/00

(52) U.S. Cl. ..... 122/406.1; 122/4 R; 122/30; 122/31.1; 392/394

(58) Field of Search ..... 122/406.1, 30, 122/4 R, 31.1; 376/361; 392/394

(56) References Cited

U.S. PATENT DOCUMENTS 3,719,172 A * 3/1973 Charcharos et al. ..... 122/7 R

FOREIGN PATENT DOCUMENTS

JP 03226695 A * 10/1991

* cited by examiner

*Primary Examiner*—Jiping Lu
(74) *Attorney, Agent, or Firm*—Wenderoth, Lind & Ponack, L.L.P.

(57) ABSTRACT

An intermediate heat exchanger-incorporated type steam generator having an intermediate heat exchanger tube 20 and a steam generating heat exchanger tube 22 disposed separately in a vessel 10 storing a secondary coolant 14 therein. A pump mechanism is made of an electromagnetic pump mechanism formed by an electromagnetic driving coil 24 provided on an outer circumference of the vessel and a magnetic core 26 attached to an inner cylinder 12 disposed in the vessel. At least one porous plate or slotted plate 18 is preferably disposed between the intermediate heat exchanger tube and steam generating heat exchanger tube.

5 Claims, 2 Drawing Sheets

INTERMEDIATE HEAT EXCHANGER-INCORPORATED TYPE STEAM GENERATOR

BACKGROUND OF THE INVENTION

The present invention relates to an intermediate heat exchanger-incorporated type steam generator provided with an intermediate heating exchanger tube and a steam generating heat exchanger tube separately in the interior of a vessel, and having a function of generating steam by forcibly circulating a secondary coolant (intermediate coolant) in the vessel to thereby subject the coolant to heat exchange. This technique is especially useful for a steam generator in a liquid sodium-cooled reactor.

In a fast breeder reactor using liquid-metal sodium as a coolant, electric power is generated by a turbine, so that a steam generator adapted to generate steam with the heat of sodium is employed. This steam generator is generally constructed so that liquid sodium is passed through the interior of a heat exchanger tube and water around the heat exchanger tube is heated and turned into steam. However, sodium has the property of violently reacting with water. Therefore, a secondary cooling system using an intermediate heat exchanger and a secondary coolant of sodium is generally employed so as to prevent the influence of the interaction of water with sodium from being exerted on a reactor core in the unlikely event of the breakage of the heat exchanger tube in the steam generator. Namely, the reactor core is cooled with a primary coolant of sodium, and a secondary coolant of sodium is heated with the heat of the primary coolant sodium in the intermediate heat exchanger. The secondary coolant sodium is then guided into the steam generator, where water is heated with the heat of the secondary coolant sodium and turned into steam.

As compared with a structure in which steam is generated in a steam generator by directly using the primary coolant sodium which has passed through a reactor core, the above-described secondary cooling system is advantageous in that the influence exerted on the reactor core is little when the heat exchanger tube should be broken, and in that activated sodium does not leak out. On the other hand, there is required various kinds of equipment in the secondary cooling system including an intermediate heat exchanger, a primary pump, piping installation, auxiliary equipment such as measurement control equipment, preheating equipment, sodium purification equipment and the like, a dump tank and so on. Also, since a large quantity of secondary coolant sodium is necessary, the cost increases. Moreover, a large space in which these various kinds of equipment are installed is also needed.

SUMMARY OF THE INVENTION

An object of the present invention, therefore, is to provide an intermediate heat exchanger-incorporated type steam generator having both functions of an intermediate heat exchanger and a steam generator so that a secondary cooling system can be simplified and a quantity of sodium coolant and an installation space required for the secondary cooling system can be greatly reduced.

Another object of the present invention is to provide an intermediate heat exchanger-incorporated type steam generator capable of securing a high safety even in the unlikely event of the breakage of a heat exchanger tube.

According to the present invention, there is provided an intermediate heat exchanger-incorporated type steam generator comprising: a vessel storing a secondary coolant therein, an intermediate heat exchanger tube and a steam generating heat exchanger tube separately disposed in the vessel, and a pump mechanism for forcibly circulating the secondary coolant in the vessel.

According to the present invention, there is also provided an intermediate heat exchanger-incorporated type steam generator comprising: a cylindrical vessel storing a secondary coolant of liquid sodium therein, an inner cylinder disposed in the cylindrical vessel to form a flow passage of the secondary coolant and divide the flow passage into flow passage portions inside and outside the inner cylinder, a helical coil-shaped steam generating heat exchanger tube disposed in an upper portion of the interior of the inner cylinder, an intermediate heat exchanger tube disposed separately from the steam generating heat exchanger tube in a lower portion of the interior of the inner cylinder, and an electromagnetic pump mechanism formed by an electromagnetic driving coil provided on an outer circumference of the cylindrical vessel and a magnetic core attached to the inner cylinder. The secondary coolant is forcibly circulated in the vessel so that the secondary coolant flows upward in the flow passage portion inside the inner cylinder and flows downward in the flow passage portion outside the inner cylinder.

In the steam generator described above, it is possible to divide the flow passage portion between the cylindrical vessel and the inner cylinder into a plurality of parts by a plurality of radially disposed partition plates. In such a case, the electromagnetic driving coil is miniaturized and a plurality of miniaturized electromagnetic driving coils are provided on the outer circumference of the cylindrical vessel.

In the preferred embodiment of the present invention, at least one porous plate or slotted plate is disposed between the intermediate heat exchanger tube and the steam generating heat exchanger tube. Thereby, the influence of the breakage of one of these heat exchanger tubes is not exerted on the other. In the case where a plurality of porous plates or slotted plates are disposed, they should be positioned with a space between each other.

PREFERRED EMBODIMENTS OF THE INVENTION

Figure 1:
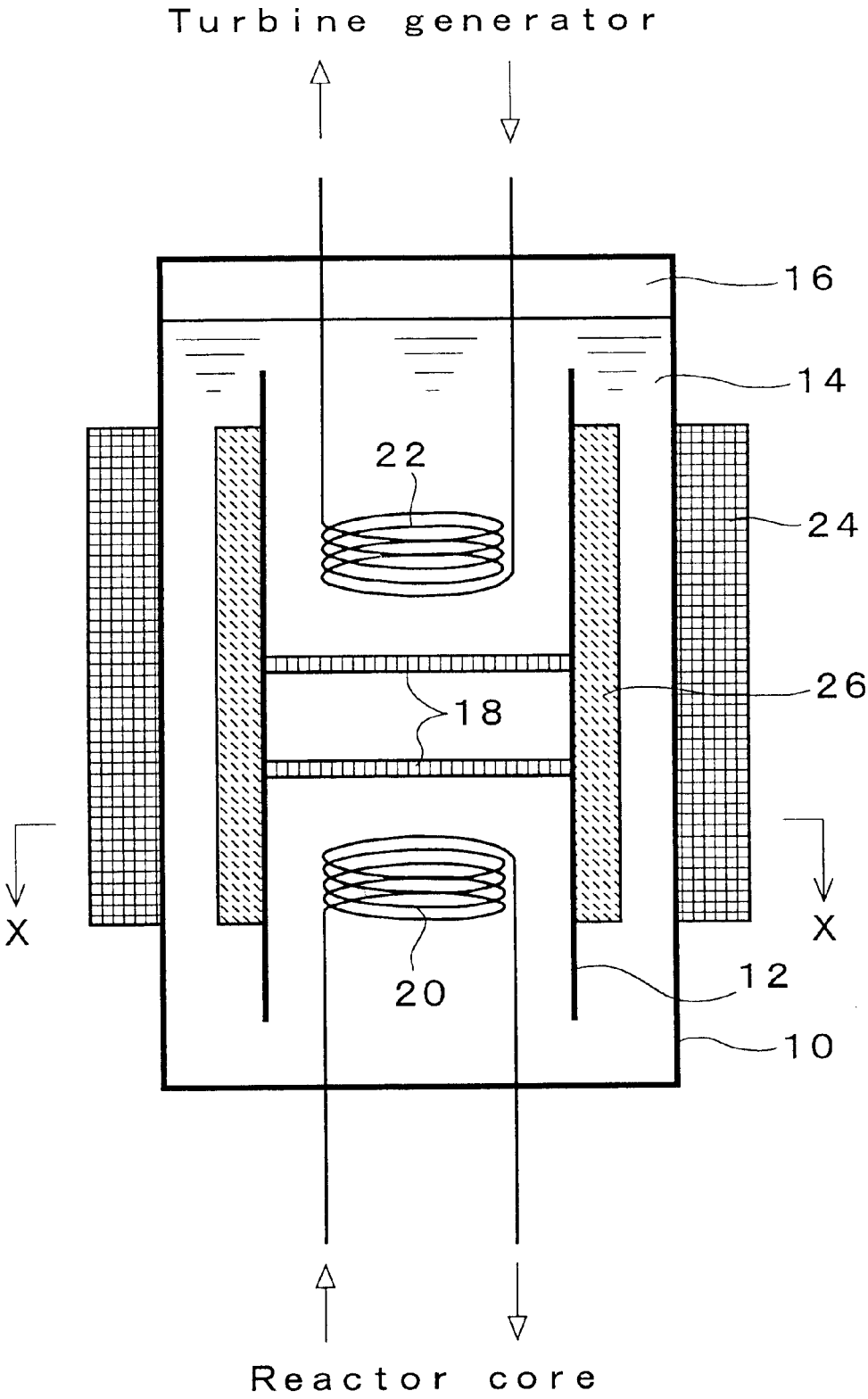
FIG. 1 is a longitudinal sectional view showing an embodiment of the intermediate heat exchanger-incorporated type steam generator according to the present invention.
Figure 2:
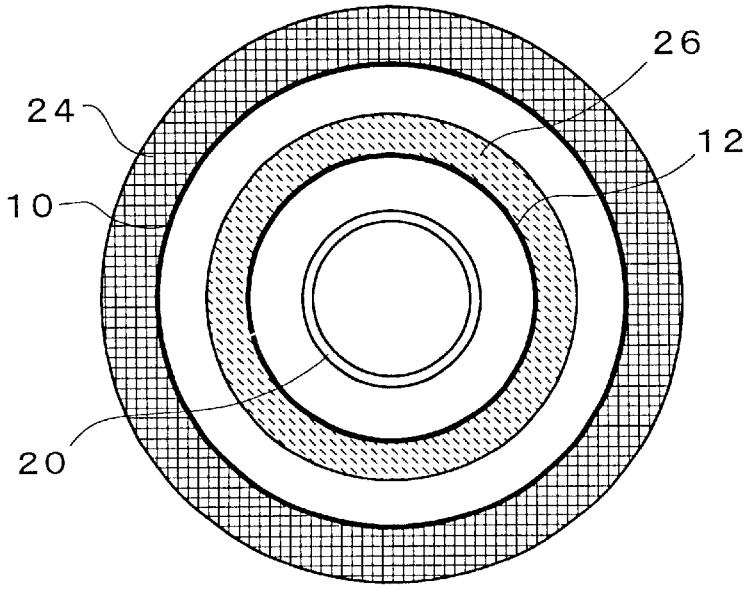
FIG. 2 is a sectional view taken along line x—x in FIG. 1.

FIG. 1 illustrates an embodiment of the intermediate heat exchanger-incorporated type steam generator according to the present invention, which is suitable for a secondary cooling system for a sodium-cooled fast breeder reactor. FIG. 1 is a longitudinal sectional view, and FIG. 2 a sectional view taken along line x—x in FIG. 1. A cylindrical vessel 10 having a bottom and an upper lid is provided in the interior thereof with an inner cylinder 12, which is arranged coaxially with and in a spaced manner with respect to the cylindrical vessel 10. The length (height) of the inner cylinder 12 is smaller than that (height) of the vessel 10, and upper and lower ends of the inner cylinder 12 are sufficiently spaced from the upper lid and the bottom of the cylindrical vessel 10, respectively. The cylindrical vessel 10 stores therein a secondary coolant (liquid sodium) 14, and an upper free liquid level is covered with a cover gas (inert gas) 16. The inner cylinder 12 fulfils the function of separating a flow passage into parts on the inner and outer sides thereof, and the flow passage portion inside the inner cylinder forms an upward flow region, while the flow passage portion outside the inner cylinder (i.e. between the cylindrical vessel 10 and the inner cylinder 12) forms a downward flow region. Accordingly, the free liquid level is set so that the upper end of the inner cylinder 12 is completely submerged in the secondary coolant 14.

Porous plates 18, which may be replaced with slotted plates, are provided in the substantially central portion of the interior of the inner cylinder 12 with respect to the vertical direction thereof. The pore diameter or slot width should be set to levels at which the liquid sodium can pass therethrough freely. The porous plates or slotted plates 18 may be provided singly, or plurally in a spaced manner. In the embodiment as shown in FIG. 1, two porous plates 18 are fixed horizontally in the interior of the inner cylinder 12 with a space between the plates. A helical coil-shaped intermediate heat exchanger tube 20 is disposed in the inner portion of the inner cylinder 12 which is below the lower porous plate 18, and a helical coil-shaped steam generating heat exchanger tube 22 in the inner portion of the inner cylinder 12 which is above the upper porous plate 18. In the present invention, since these heat exchanger tubes 20, 22 are formed helically, these heat exchanger tubes can be made compact and held easily in the interior of the cylindrical vessel 10. Further, by disposing the steam generating heat exchanger tube 22 and the intermediate heat exchanger tube 20 in the vertically positional relation, the flow direction of the secondary coolant 14 around these heat exchange tubes 20, 22 in the interior of the inner cylinder 12 is set upward, and the heat exchange efficiency is thereby improved.

An electromagnetic driving coil 24 is provided on an outer circumference of the cylindrical vessel 10, and a magnetic core 26 is attached to the inner cylinder 12. The coil and core form an electromagnetic pump, which drives the secondary coolant (liquid sodium) 14. The heat exchange efficiency is improved and the dimensions of the steam generator are reduced by forcibly circulating the secondary coolant 14 in the cylindrical vessel 10. By providing the electromagnetic driving coil 24 on the outermost circumferential portion of the cylindrical vessel 10 in such a manner, the driving coil 24 is made compact and integrated with the cylindrical vessel 10. Furthermore, the provision of the electromagnetic driving coil 24 on the outermost circumferential portion of the cylindrical vessel 10 enables, not only a self-cooling operation, but also a forced cooling operation to be carried out.

The primary coolant (liquid sodium), which is heated as it flows through the reactor core, reaches the intermediate heat exchanger-incorporated type steam generator, flows through the interior of the intermediate heat exchanger tube 20 and transmits heat to the secondary coolant (liquid sodium) 14 existing around the intermediate heat exchange tube 20. The thus heated secondary coolant (liquid sodium) 14 flows up in the inner cylinder 12, passes through the pores or slots of the porous plates or slotted plates 18, flows around the steam generating heat exchange tube 22, and transmits heat to the water flowing through the interior of the steam generating heat exchanger tube 22. The water passing through the steam generating heat exchange tube 22 is thereby heated, and turned into steam, which flows out from the intermediate heat exchanger-incorporated type steam generator toward a turbine generator and the like.

In the present invention, the efficiency of the heat transfer from the primary coolant (liquid sodium) in the intermediate heat exchanger tube 20 to the secondary coolant (liquid sodium) 14, and that from the secondary coolant (liquid sodium) 14 to the water in the steam generating heat exchanger tube 22 are improved by forcibly fluidizing and circulating the secondary coolant (liquid sodium) 14 in the interior of the cylindrical vessel 10 by using the electromagnetic pump mechanism. In the illustrated embodiment, an induction type electromagnetic pump mechanism having a simple duct structure and not requiring an electrode to which an electric current is supplied from the outside is formed by the electromagnetic driving coil 24 provided on the outer circumference of the cylindrical vessel 10 and the magnetic core 26 attached to the inner cylinder 12, so that the secondary coolant (liquid sodium) 14 in the cylindrical region between the inner cylinder 12 and cylindrical vessel 10 can be driven downward. The electromagnetic driving coil 24 is a coil for driving a conductive fluid (secondary coolant sodium) which is formed by spatially shunt winding, for example, a 3-layer winding, and adapted to generate a traveling magnetic field by supplying a 3-phase alternating current thereto. The magnetic core 26 fulfils the functions of strengthening the magnetic field and improving the driving efficiency.

Even when a hydrogen gas is generated due to an interaction of the water or steam flowing in the steam generating heat exchanger tube 22 with the secondary coolant (liquid sodium) 14 which occurs in the unlikely event of the breakage of the steam generating heat exchanger tube 22, the porous plates or slotted plates 18 fulfill the functions of protecting and isolating the intermediate heat exchanger tube 20 so that the influence of such an interaction does not cause the soundness of the intermediate heat exchanger tube 20 to be lost.

Even when a material reactive with the primary coolant is used as the secondary coolant, the porous plates or slotted plates can also fulfill the functions of preventing the influence of an interaction of the primary coolant and the secondary coolant, which occurs when the intermediate heat exchanger tube 20 is broken, from being exerted directly on the steam generating heat exchanger tube 22 and causing the soundness of the heat exchanger tube 22 to be lost.

When it is necessary to cool the electromagnetic driving coil 24 of the electromagnetic pump mechanism, the outer circumference of the cylindrical vessel 10 is covered with an insulating material (not shown), and the electromagnetic driving coil 24 is provided on the outer side of the insulating material. Such an arrangement can be taken, since the electromagnetic coil 24 is provided on the outermost surface of the cylindrical vessel 10, and this arrangement enables the electromagnetic driving coil 24 to be self-cooled or forcibly cooled.

Figure 3:
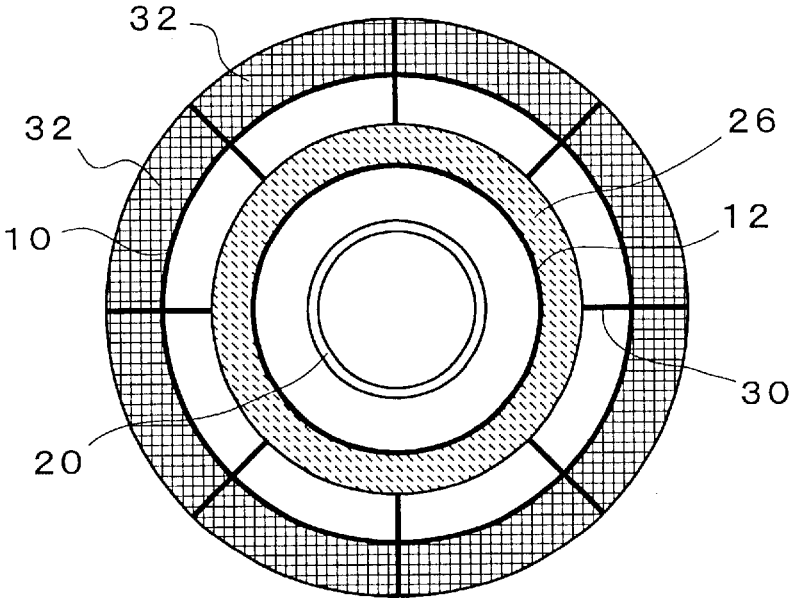
FIG. 3 is a sectional view showing another embodiment of the present invention.

FIG. 3 shows another embodiment of the present invention. This figure is a drawing prepared so as to correspond to FIG. 2, which is taken along line x—x in FIG. 1. To simplify the description of the embodiment, the same reference numerals as in FIG. 2 will be assigned to the corresponding members. In this embodiment, the flow passage between the cylindrical vessel 10 and the inner cylinder 12 is divided into a plurality of parts by a plurality of radially disposed partition plates 30, and the electromagnetic driving coil 32 is also miniaturized and provided plurally. In this embodiment, there is shown an example in which the flow passage is divided into eight flow passage portions by eight partition plates 30 and eight miniaturized electromagnetic driving coils 32 are separately arranged. In this structure, even the difficulty of manufacturing a large current large-sized electromagnetic pump can be dealt with by combining a plurality of miniaturized electromagnetic driving coils 32 together, and the advantages of easily manufacturing the miniaturized coils and easily carrying out maintenance work thereof are obtained.

As will be understood from the foregoing, the intermediate heat exchanger-incorporated type steam generator of the present invention can attain the same functions as those of a prior art secondary cooling system constituting an intermediate heat exchanger, a secondary piping, a secondary pump, a steam generator and the like. Moreover, the necessary equipment and installation space can be reduced greatly, and the length of piping can be shortened, as compared with the prior art secondary cooling system.

Further, in the present invention, one or more of the porous plates or slotted plates may be disposed between the intermediate heat exchanger tube and the steam generating heat exchanger tube. Such a structure can prevent an interaction of the primary coolant flowing through a reactor core with water or steam when either of these heat exchanger tubes is broken, and enables sufficient safety to be secured.

What is claimed is:

1. An intermediate heat exchanger-incorporated type steam generator comprising:

a vessel for storing a secondary coolant therein;

an intermediate heat exchanger tube and a steam generating heat exchanger tube separately disposed in said vessel; and a pump mechanism for forcibly circulating the secondary coolant in said vessel, wherein at least one porous plate or slotted plate is disposed between said intermediate heat exchanger tube and said steam generating heat exchanger tube so that the influence of the breakage of one of said heat exchanger tubes will not be exerted on the other.

2. An intermediate heat exchanger-incorporated type steam generator comprising:

a cylindrical vessel for storing a secondary coolant of liquid sodium therein;

an inner cylinder disposed in said cylindrical vessel to form a flow passage for the secondary coolant and divide said flow passage into flow passage portions inside and outside said inner cylinder;

a helical coil-shaped steam generating heat exchanger tube disposed in an upper portion of the interior of said inner cylinder;

an intermediate heat exchanger tube disposed separately from said steam generating heat exchanger tube in a lower portion of the interior of said inner cylinder; and an electromagnetic pump mechanism formed by an electromagnetic driving coil provided on an outer circumference of said cylindrical vessel and a magnetic core attached to said inner cylinder;

wherein the secondary coolant is forcibly circulated in said vessel so that the secondary coolant flows upward in said flow passage portion inside said inner cylinder and flows downward in said flow passage portion outside said inner cylinder.

3. An intermediate heat exchanger-incorporated type steam generator according to claim 2, wherein said flow passage portion between said cylindrical vessel and said inner cylinder is divided into a plurality of parts by a plurality of radially disposed partition plates, said electromagnetic driving coil is miniaturized and a plurality of said miniaturized electromagnetic driving coils are provided on the outer circumference of said cylindrical vessel.

4. An intermediate heat exchanger-incorporated type steam generator according to claim 3, wherein at least one porous plate or slotted plate is disposed between said intermediate heat exchanger tube and said steam generating heat exchanger tube.

5. An intermediate heat exchanger-incorporated type steam generator according to claim 2, wherein at least one porous plate or slotted plate is disposed between said intermediate heat exchanger tube and said steam generating heat exchanger tube.

* * * * *